US005752439A

United States Patent [19]

LaMora, Jr.

[11] Patent Number: 5,752,439

[45] Date of Patent: May 19, 1998

[54] RECONFIGURABLE VERTICAL COMPACTOR

[75] Inventor: Robert E. LaMora, Jr., Glassboro, N.J.

[73] Assignee: Accurate Industries, Erial, N.J.

[21] Appl. No.: 749,998

[22] Filed: Nov. 15, 1996

[51] Int. Cl.[6] ..... B30B 15/04

[52] U.S. Cl. ..... 100/229 A

[58] Field of Search ..... 100/229 A

[56] References Cited

U.S. PATENT DOCUMENTS

| | | | |
|---|---|---|---|
| 4,022,123 | 5/1977 | Bachmann . | |
| 4,804,289 | 2/1989 | Blough . | |
| 4,896,593 | 1/1990 | Slusser . | |
| 5,025,721 | 6/1991 | Spiers . | |
| 5,062,358 | 11/1991 | Fox . | |
| 5,315,924 | 5/1994 | Kruzick | 100/229 A |
| 5,421,251 | 6/1995 | Bruke . | |

*Primary Examiner*—Stephen F. Gerrity
*Attorney, Agent, or Firm*—Eckert Seamans Cherin & Mellott

[57] ABSTRACT

A vertical compactor has a frame with legs spaced to receive an upwardly opening dumpster or similar container. A compactor head mountable on top of the frame has a feed inlet for receiving material and a ram pivotable downwardly into the container. The frame has two parallel guide members slidably supporting the container and opening at flared flanges on both opposite sides of the frame. Thus the container is insertable and removable from either side. A remountable stop is attachable to at least one of the frame and the compactor head to close one side such that the container can be inserted into the other side and slides up to abut the stop. The stop can be a cross bar extending between ends of upper structural rails, remountable on either end of the rails, for example using a shackle and pin coupling, and/or can have holes aligned with holes in the compactor head for receiving fasteners. Attachment holes are provided on each of the edges of the head, and the head can be rotated on the frame to orient the feed inlet in any direction at 90° intervals. For preventing the compactor ram from incrementally moving the container out of the frame when oriented to exert a force in that direction, wedge shaped backout preventing shoes are providing on the guides, at least on the container load/unload side of configurations having the trash feed inlet and the stop located on the same side.

14 Claims, 2 Drawing Sheets

RECONFIGURABLE VERTICAL COMPACTOR

BACKGROUND OF THE INVENTION

1. Field of the Invention

The invention relates to a compactor for packing refuse into a container. A container such as a dumpster is removably received in a frame carrying a compacting head having a ram that pivots to press material into the container.

According to the invention, a vertical compactor head with a lateral feed inlet is mounted at any of four 90° intervals on a frame having oppositely oriented container guides for receiving the container from either of two opposite sides. This provides a range of options upon installation, as to the direction in which the compactor is to be fed and the direction from which the container is loaded into the frame and unloaded for dumping.

The frame is configured for loading on a desired load/unload side by fixing a container stop bar to either or both of the frame and the compactor head on the side opposite from the container load/unload side, so as to extend into the path of the container. After installation the frame can be reconfigured for opposite side loading simply by moving the stop bar, which is removably mounted, for example using bolts or using holding pins captured by cotter pins for affixing the stop bar to the frame and/or head.

At least one of the open sides of the frame is provided with a second stop in the form of wedge-shaped feet that are welded to the frame, for example at the inlets to horizontal slides. Each of the feet has an abutment directed inwardly to hold the container in place in the frame. The container slides in over the feet to rest behind the abutment and is lifted over the abutment during unloading. The feet are provided at least on the side of the frame opposite from the stop bar, and prevent the container from being backed out of the frame by action of the pivoting compactor ram, which would urge the container out of the frame if configured with the stop bar and the compactor feed inlet located on the same side.

2. Prior Art

Trash compactors are popular and efficient for storing trash in a smaller space than the trash normally would occupy. Compactors that are large enough to employ a dumpster or similar container are used, for example, at retail establishments and fast food stores to compress packing materials and trash, etc. For this purpose, a self-contained compactor head having a powered ram mechanism can be mounted on a frame forming a space to receive a removable container. In a compactor with a vertical mechanism (e.g., having ram plate mounted on a horizontal pivot axis for compressing the trash downwardly), the container is open over at least part of the top and is received in a frame that supports the compacting mechanism over the open top of the container. The frame is substantially a box frame, open on at least one lateral side, and can have one or more supporting structures such as laterally spaced slides, to support and guide the removable dumpster container into position within the frame, immediately under the compactor head.

Typically the head has a housing containing an electrically powered hydraulic pump and one or more hydraulic cylinders coupled to advance the ram, for example to pivot a ram plate downwardly from a horizontal plane coinciding with the top edge of the container. Linearly advanced rams and rotating augers are also possible, but a pivoting ram plate arrangement is advantageous. A trash inlet is provided in the housing of the compactor head and has an external door that can be electrically interlocked to prevent compactor operation when the door is open, and mechanically interlocked to prevent the door from opening unless the pivoting ram is in its fully retracted position.

The hydraulic ram or the like in the compactor head presses trash fed into the inlet downwardly into the container. With a pivoting hydraulic ram, the ram pivots across the inlet and into the container for compacting the trash and then is retracted into the compactor head to clear the inlet for another load. Due to the pivoting of the ram plate, a pivoting ram exerts a force on the trash in a direction lateral of the pivot axis.

Assuming that the inlet or feed side of the compactor is deemed the front, the ram encompasses the front part of the area of the container as viewed in plan, pressing downwardly and to the rear. As the trash is compacted into the front of the container, previously-fed trash is pushed downwardly in front, to the rear at the bottom, and upwardly at the rear, in a generally semicircular path around a horizontal axis. The internal shape of the bottom of the container can be rounded to complement this action. Apart from the pivoting hydraulic ram that extends into the container during a compaction cycle, the underside of the compactor head is flat and forms a cover over the open top of the container.

When one typical type of dumpster is emptied, the container is engaged on opposite lateral sides by spaced manipulators of a trash collection truck. For example, the container can have horizontal channels welded onto its lateral sides for engagement by fork-like spaced arms on a dumping mechanism of the truck. The arms are rotated down to extend forward from the truck. The truck moves forward to engage the container. The manipulator arms are lifted slightly to bear the weight of the container, and as the truck backs up, the container is moved clear of the compactor frame. The arms are rotated up to dump the contents of the container through an opening on top of the truck. After dumping, the reverse of this operation re-inserts the empty container back into the frame.

Other methods for moving and/or dumping the container are also possible. For example, the container can have ground engaging wheels. The container can be liftable on manipulators to dump into the top of a truck, or structured for pivoting upward at the rear of a truck to dump into a rear receptacle. The container can rest on the ground or can be supported in the frame of the compactor by horizontal guides or other supporting surfaces, either in contact with the bottom of the container or with flanges extending laterally from the container and spaced upward from the bottom.

In U.S. Pat. No. 5,025,721—Spiers, for example, the bottom of the container rests substantially on the ground between the vertical legs of the frame. In U.S. Pat. No. 4,896,593 —Slusser, the container is supported on the bottom by horizontal angle brackets that are spaced slightly above the ground and are affixed to the frame. Structural cross members are attached transversely, including at least one cross member that closes a rear side of the frame. During installation of the compactor, the frame is oriented such that the open side of the frame faces a convenient direction for approaching the frame to insert and remove the container.

The angle brackets of the Slusser frame have flaring ends on the open side of the frame, namely the load/unload side from which the truck accesses the compactor. Due to the flaring ends of the angle brackets, one need not be exactly accurate in positioning the container between the legs of the frame on the load/unload side, for insertion into the frame.

The truck operator, for example, need only insert the container between the flaring ends, and the flaring ends of the angle brackets guide the container into place as the truck advances.

The structural cross members closing the rear of the frame form a stop that prevents the container from being pushed through the frame when inserted. As the container is inserted via the manipulating members of the truck, the rear wall of the container comes into contact with the stop. Further advance of the truck causes the manipulating members to slide relative to the container. The truck operator then stops, lowers and retracts the manipulators, leaving the container in a fully-inserted position.

In addition to the vertical legs, horizontal supporting structure (e.g., angle brackets), if any, and the cross member or members forming the stop, the frame includes structural members extending between the legs to generally form a strong and durable rectilinear box frame encompassing the container, open on one side. Although the open side can be oriented in any direction during installation to accommodate the planned path of the truck, to change this direction afterwards involves disassembling the frame and rebuilding it with the open side facing in a different direction, or else detaching the frame from the ground and rotating and remounting the frame so that the open side is oriented elsewhere.

It is advantageous as in the foregoing patent to Slusser, to make the frame and the compactor head both square in plan view. If so, the compactor head can be mounted with the inlet opening facing the front, back or either side of the frame. This allows customization of the overall configuration for a particular installation. The compactor frame is installed with the container load/unload side facing a convenient direction of approach for the truck, and the compactor head is installed with the inlet facing a convenient direction of approach for a person seeking to feed in trash. However, the ram of the compactor, which pivots, has a horizontal force component. If the compactor is set up such that the ram pivots toward the open end of the frame, the ram exerts a force tending to push the container out of position. This occurs, for example, if the trash feed inlet and the container load/unload sides are on opposite sides.

The compactor head must be rigidly fixed to the frame, for example being welded or bolted to the frame, because the ram exerts a substantial downward pressure (e.g., 14 tons or about 12,500 kg). The ram could tend to lift and displace the compactor head when the container is full if the head is not rigidly fixed. In addition, the frame is normally fixed to the ground so that the truck does not inadvertently lift or move the frame when manipulating the container. If the frame is bumped out of precise alignment with the approach direction of the truck, the possibility of further bumping of the frame is increased. Repetitive minor displacements of the frame over time accumulate and may cause the compactor to encroach on an unwanted area. Finally, it is useful if the frame is kept stationary to make it easier to place and remove the container without the need to follow a moving target.

A permanent installation therefore is preferred. It is possible after making an installation to change the orientation of the feed inlet door, chute or the like, by detaching and rotating the compactor head. It also is possible after making an installation to detach the frame from anchor bolts sunk in the ground, and to rotate the frame and re-attach it to the ground. In that event it may be necessary also to detach, rotate and remount the compactor head to regain the previous orientation or the inlet. Such changes are not easily accomplished.

It would be advantageous to provide a compactor with a frame that is reconfigurable as to the approach direction, without undue disruption. Preferably the frame should be capable of being reconfigured without detaching the frame from the ground or substantially rebuilding the frame. According to the present invention, the load/unload side of the frame can be changed without moving the compactor head or substantially disassembling and reassembling the structural elements of the frame. Instead, the change is made by detaching the rear stop bar using at most simple hand tools, for removing bolts and/or a locking pin captured by a cotter pin, and moving the rear stop bar from one side to the other, both sides otherwise being configured to receive a container. In addition, one or both sides are provided with supplemental stops that retain the container against the cross member stop, so that the compactor can be configured, if desired, with the trash feed inlet and the ram located on the opposite side from the load/unload direction, without causing the ram to progressively push the container out of the frame. In that case the supplemental stops are placed at least on the container load/unload side, opposite from the stop and the trash feed inlet side.

SUMMARY OF THE INVENTION

It is an object of the invention to provide a vertical compactor with a frame that can be reconfigured in the field without substantial disruption, as to the approach direction used to access the container.

It is also an object of the invention to permit a compactor frame to be reconfigured without the need to detach the frame from the ground.

It is a further object of the invention to reconfigure the frame approach direction without the need to detach and remount the compactor head if the feed direction is to be left as before.

It is another object to provide a frame that can be reconfigured using minimal steps, and preferably without the need for additional parts.

These and other objects are accomplished by a vertical compactor having a frame with four legs spaced to receive an upwardly opening dumpster or similar container. A compactor head mountable on top of the frame has a feed inlet for receiving material and a ram extendable downwardly into the container for compacting the material, preferably a pivoting hydraulic ram. The frame has two parallel guide members slidably supporting the container and opening on both opposite sides of the frame such that the container is insertable and removable from either side and slides along the guide members. A remountable stop is attachable to one or both of the frame and the compactor head, at either of the two sides, such that the container can be inserted into the other side and slides up to abut inwardly against the stop when correctly positioned.

According to one embodiment, the stop can be a cross bar extending between the laterally opposite sides of the frame, and is remountable on either of the front or rear, for example, using shackle couplings on the ends of a bar, tube or beam, to engage on either end of the lateral sides of the frame, both having a fitting by which the shackles can be affixed, preferably locking via a pin or bolt captured with a cotter pin. Alternatively, the stop bar can be bolted or pinned to the underside of the compactor head at the rear of the frame for defining the end position of the container.

In this manner the compactor frame is reconfigurable to receive the container on either the front or rear. It is not necessary to rotate and remount the frame, and possibly also the compactor head, in order to make a desired change. However, the arrangement permits the compactor head to be installed on the frame with the trash feed inlet oriented as desired.

The parallel guide members for supporting the container define passages that flare at least laterally and preferably also vertically leading into the frame, and can include angle iron guides for supporting the container from below. The flaring passages are provided both on the front and rear of the frame, either of which can become the load/unload side. Alternatively or in addition, bars having tapered ends can support the container under lateral flanges, e.g., along the open top of the container.

Preferably, the frame and the compactor head are complementary and square in plan. Thus the head can be rotated on the frame during installation or thereafter to orient the feed inlet in any direction at 90° intervals. The compactor head can have a corresponding pattern of holes one each of its four edges, for receiving bolts or pins to engage the frame on the sides and optionally also the stop bar, the holes at the load/unload side being unused. Typically the trash feed inlet direction is related to a fixed structure (e.g., facing the back entrance of a retail establishment) and need not be changed. However, changes in traffic patterns and changes in the usage of space adjacent to the compactor may dictate that the container load/unload direction be changed.

The frame and the compactor head can be complementary and rectangular in plan, such that the feed inlet can be oriented in either of two opposite directions by rotation of the compactor head relative to the frame. By making the compactor head externally rectangular but placing and sizing the ram to extend downwardly only within a square having a side equal in length to a shortest side of the rectangle, the compactor head is alternatively mountable on a smaller square frame or on a larger rectangular frame.

Additionally, the compactor and/or container can be made reconfigurable for changing the capacity of the container used, for example reconfiguring a compactor to use an eight cubic yard container instead of a six yard one. This is accomplished by using a retrofit kit to add a frame extension between the original frame and the compactor head, for spacing the compactor head higher up on a frame having the same size in plan, and receiving a taller container having the larger capacity. The retrofit can have holes corresponding to those of the compactor head and the original frame. The smaller container can be replaced with a new and taller container, or the walls of the shorter container can be extended upwardly with another retrofit kit.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
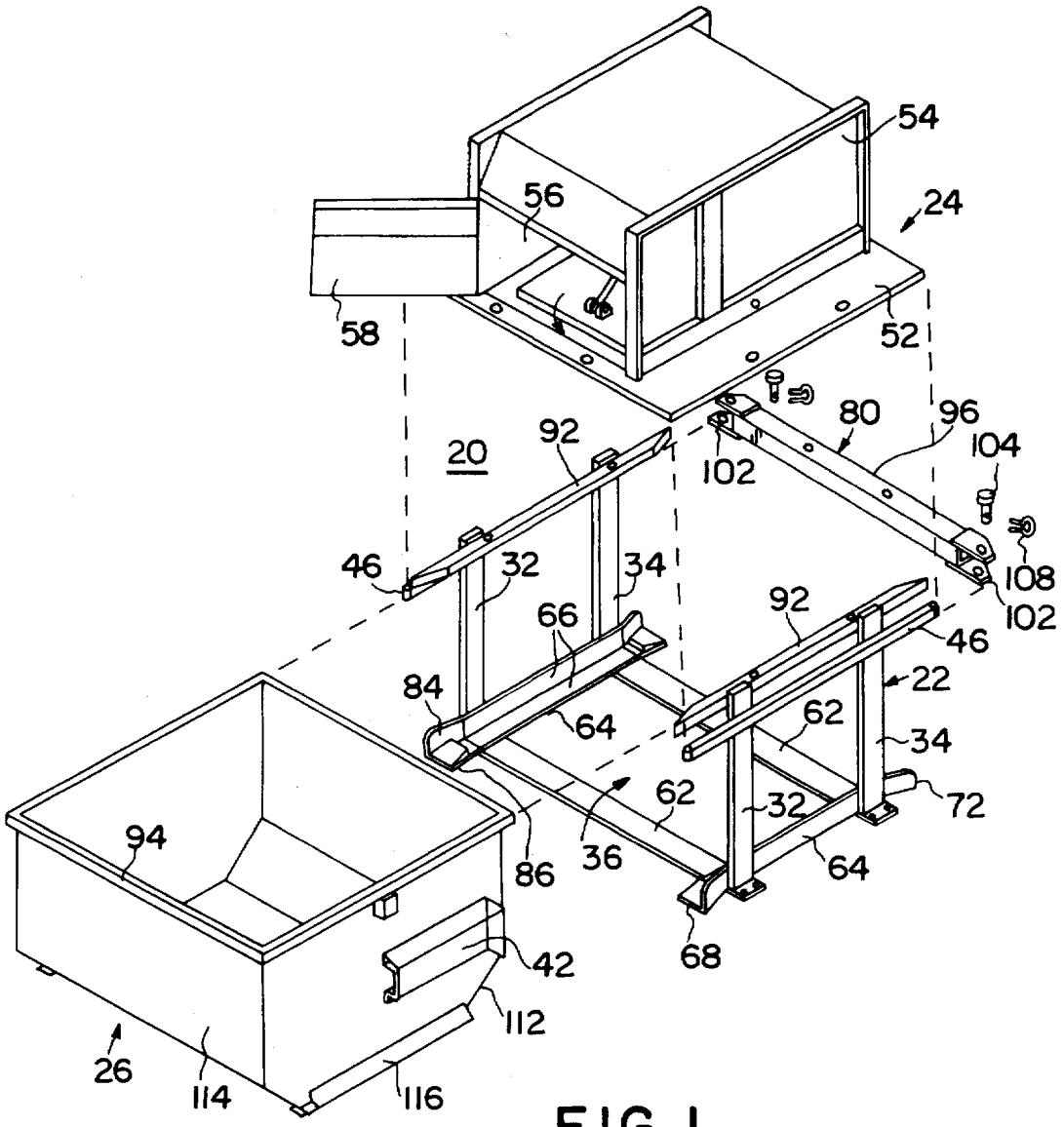
FIG. 1 is an exploded perspective view illustrating the inventive vertical compactor.

FIG. 1 illustrates the major components of a compactor 20 in accordance with the invention, namely a frame 22, a compactor head 24 and a container 26. Compactor 20 as shown is a vertical compactor and is an improvement with respect to the type disclosed, for example, in U.S. Pat. Nos. 5,025,721—Spiers and 4,896,593—Slusser, the disclosures of which are hereby incorporated in their entireties. In general, the compactor frame 22 has at least four vertical legs 32, 34 that are connected together structurally and are spaced and dimensioned to define an opening 36 for receiving upwardly opening container 26 between the legs 32 and 34, such as a dumpster.

In the embodiment shown the dumpster has side channels 42 by which container 26 can be engaged by a collection truck (not shown) having spaced fork-like manipulators for moving the container or dumpster 26 horizontally and for lifting and dumping it. Various other forms of containers and dumpsters are also applicable, such as those having front engageable structures, those with wheels, those engageable from underneath via a forklift or the like, etc., the embodiment of the container as shown being merely exemplary. In any event, container 26 is inserted into a space defined by frame 22, for filling the container with compacted trash, and is removed for dumping or to be replaced by another empty container of comparable size.

Compactor head 24 is rigidly mounted on top of frame 22 over the area occupied by container 26. The compactor head 24 can be bolted or fixed by pins, preferably using soldier bolts or pins having cotter pins (not shown) to remain securely attached notwithstanding vibration and the downward pressure exerted by the compacting mechanism during compacting cycles. In the embodiment shown, compactor head 24 is attachable by two bolts on each side to inner frame rails 92. Inner frame rails 92 and outer frame rails 46 are welded to vertical legs 32, 34 of frame 22. The compactor head 24 has a base 52 forming a cover over container 26 when inserted into frame 22 and a housing 54 protruding above this cover, containing a mechanism (only the ram being shown) whereby downward pressure can be exerted on material placed into a feed inlet 56. Base 52 of compactor head 24 has corresponding bolt holes on all four sides, enabling the head to be oriented in any direction for attachment to rails 92. Only the bolt holes on two sides are used at any time for attachment to the frame rails at the sides.

The feed inlet 56 in the embodiment shown has a pivotable door 58, preferably electrically interlocked to permit operation of the compactor mechanism only when the door is closed, as well as mechanically interlocked with the ram so that the door can only be opened when the ram is fully retracted. Other specific feed structures are possible for feed inlet 56, such as a chute that distances the point at which material is loaded from the area of the compacting ram. Preferably the mechanism comprises a conventional vertical compacting ram, such as disclosed in the foregoing Slusser patent, operable by powered means such as a hydraulic pump and cylinder to pivot and extend a ram plate downwardly, through the area holding newly loaded material, and into container 26 for compacting the material into and in the container. The invention is also applicable to linear rams, augers and other known compacting mechanisms.

In addition to legs 32, 34, and upper frame rails 46, 92, frame 22 has lower structural members 62, 64, rigidly coupled between legs 32, 34, for example by welding. Transverse lower connecting members 62 couple between the lower ends of legs 32 and 34 and substantially rest on the ground. In the embodiment shown, frame 22 has two lower parallel guide members 64 extending between adjacent legs 32, 34 on each side, parallel to the direction in which container 26 is inserted or removed. These lateral lower guide members 64 structurally connect legs 32 and 34 and also slidably support container 26. The lower guide members 64 comprise angle iron with flanges 66 opening upwardly and inwardly. Guide members 64 open on both opposite sides of the frame, namely on the side 68 facing container 26 in FIG. 1 and also on the opposite side 72. Thus the lower guide members 64 of frame 22 would permit receipt of container 26 from either of said two opposite sides 68, 72 for sliding along the guide members. The side 68 facing the container can be deemed the "front" of frame 22 for loading/unloading of the container as shown; however in connection with this disclosure, terms such as "front," "rear" and "side" are relative because frame 22 is readily configurable to make either of sides 68 or 72 the side at which the container is accessed, and to orient the trash feed inlet toward any of the four sides.

A remountable stop 80 is attachable to one or both of the frame 22 and the compactor head 24, at a first of the two opposite sides (the rear 72 of frame 22 in FIG. 1) to block sliding of container 26 beyond a point of abutment between container 26 and stop 80. In the embodiment shown, stop 80 is attachable to the ends of rails 46 so as to extend across the path of container 26 during insertion into frame 22, blocking the rear side 72. Alternatively or in addition, stop 80 can be attached to the underside of compactor head 24 using pins or bolts through the holes in the deck of the compactor head on the side of stop 80 (obscured in FIG. 1). Container 26 is insertable from the front 68 (the other of the two opposite sides) and slidably movable to abut inwardly against stop 80, which is securely fixed but remountable. In the inserted position, container 26 is properly placed relative to compactor head 24 and the ram therein, preferably such that the ram pivots vertically downwardly into the front part of container 26. In the configuration shown in FIG. 1, the pivoting ram exerts a pressure on the contents of container 26 directed down and to the rear, i.e., downwardly and in the direction of stop 80.

Stop 80 is remountable on the other of the opposite sides, namely at the front 68 in FIG. 1, to reconfigure frame 22 for receiving container 26 on the side 72 opposite that shown in FIG. 1 (the "rear"). An identical structure for receiving stop bar 80 is likewise provided at the front ends of rails 46 and along the front edge of the compactor deck. Accordingly, by removing stop 80 from the position shown and attaching it at the front, frame 22 is reconfigured for loading or unloading container 26 in an opposite load/unload direction, without additional parts and without the need to disturb the existing orientation of feed inlet 56 on compactor head 24.

Lower guide members 64 define a flared passage leading into frame 22 at both of the opposite sides 68, 72 for guiding container 26 into the frame even if the container is somewhat inaccurately positioned and would otherwise bump against one of the legs 32 or 34 on the side of insertion. The flared passages into the space between angle irons 66 is formed by welding entry flanges to the ends of the angle iron, comprising a generally vertical flange plate 84 and a generally horizontal flange plate 86, which are diverted laterally outwardly and preferably also downwardly (respectively), relative to the flanges of angle iron 66.

Instead of using lower guide members 64 for supporting container 26 from below as described, or preferably in addition to such lower guide members, frame 22 comprises upper lateral slide bars 92 that support container 26 from under a lateral flange 94 of the container. The upper slide bars 92 are tapered outwardly at their ends, namely at the opposite alternative insertion sides 68, 72 of frame 22. Therefore, slide bars 92 likewise provide an inlet path that flares outwardly in a manner similar to lower guide members 64, for enlarging the entrance dimensions and guiding container 22 into position as the container is inserted into frame 22.

Figure 2:
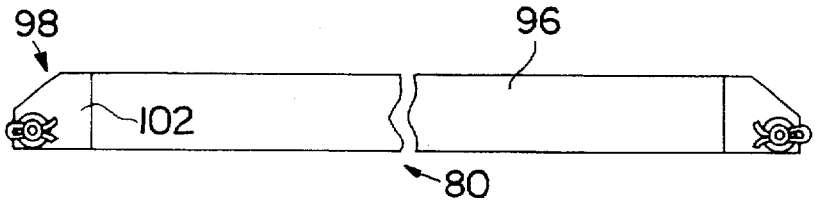
FIG. 2 is an elevation view illustrating a remountable stop bar according to the invention, for attachment to the frame of FIG. 1 between the legs on the side opposite from the container load/unload side.
Figure 3:
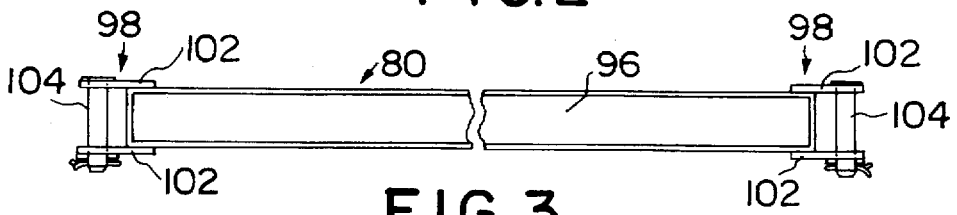
FIG. 3 is a top plan view of the stop bar as shown in FIG. 2.

The legs 32 or 34, rails 46, 92 and/or compactor deck 52 can be used for attaching stop 80 either on the front 68 or the rear 72, to set the full insertion position of container 26 in one direction or the other. In the embodiment shown, stop 80 comprises a bar 96 with fittings 98 for engaging the ends of rail 46 on either of the opposite sides 68, 72. Stop 80 can alternatively or additionally have bolt holes for attachment to the compactor deck, as described. The stop bar 96 can be structured, for example, as shown in FIGS. 2 and 3, and is endwise attachable to rail 46 as shown in FIG. 4.

Each of the end fittings 98 of bar 96 comprises a shackle formed by two plates 102 welded to opposite sides of bar 96 so as to extend at each end and provide a space between them for engaging around the end of rail 46, which has a vertical opening for a pin 104. Bar 96 can comprise a length of rectangular tubing, or can comprise a solid I-beam or a similar structure. The two plates 102 at each end extend over the end of bar 46, which can have a vertical tube welded thereto or can simply be bored. Plates 102 have aligned openings for the pin 104 for fixing stop bar 96 to frame 22 in a durable but removable manner. Pins 104 can extend through washers 106 as shown in FIG. 4 and are captured by a cotter pin 108 or the like through a transverse bore in pin 104.

Figure 4:
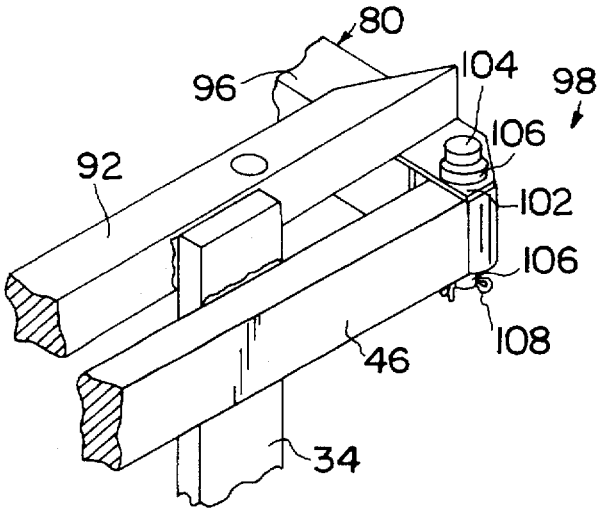
FIG. 4 is a partial perspective view showing the assembled frame structure at the attached stop bar.

In FIGS. 1 and 4, stop bar 96 is disposed at the top rear of frame 22 (the opposite side from the insertion side). It is also possible to mount the stop bar lower, for example by providing similar fittings on the legs or on the lower structural members.

Container 26 has inclined lower walls 112, which tend to make the bottom of the container rounded and contribute to a general circular passage of material down and rearwardly with downward and rearward pivoting of the ram. In addition, container 26 has channel 42 for receiving manipulators and wear bars 116 welded to the lower lateral edges, protruding laterally and downward at the bottom, as shown in FIG. 1.

Figure 5:
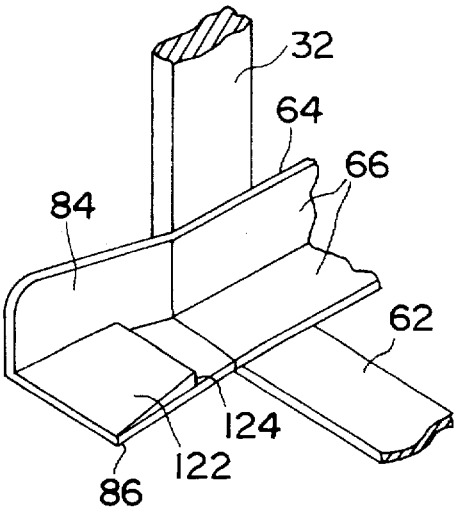
FIG. 5 is a partial perspective view of a portion of the frame as in FIG. 1, including a backout preventing shoe.

Whereas the compactor head 24 can be installed with the inlet 56 facing in any direction, a problem can be encountered in that the force of the ram in one configuration is exerted in the direction of the open end of frame 22, instead of toward the end closed by stop bar 80 or either of the lateral sides where the frame or stop would hold the container. With the vibration of compaction and the mechanical forces associated with the ram, the container can progress incrementally out of the frame over a number of compaction cycles. It is advantageous as shown in FIG. 5 to provide a stop that is active in a direction opposite to the direction of insertion in such a configuration, to prevent the container from moving out of frame 22. A backout preventing shoe 122 is preferably provided on each of the lower guide members 64, at least for the load/unload side in configurations in which the stop bar and the trash inlet are on the same side (opposite from the load/unload side). The shoes 122 can be provided on both side to provide for the possibility of moving both the stop 80 and the trash inlet 56.

The backout preventing shoe, for example, comprises a wedge that is thicker leading inwardly of frame 22 and thinner at the outer edge of guide members 64. When the container is inserted into frame 22, its lower edge slides over backout shoe 122. Shoe 122 has an inner dropoff or abutment 124, and the edge of the container drops over this abutment when fully inserted. Container 22 must be lifted slightly when being retracted from frame 22 in order to raise the ends of wear bars 116 over abutment 124. However the clearance provided for container 22 in frame 22 is sufficient to permit the container to be raised over abutment 124, and in the case of a truck having fork-like manipulating arms the operator generally lifts container 26 slightly to ensure that the container is engaged as well as to avoid undue abrasion between the frame and the container.

As shown in FIG. 1, frame 22, compactor head 24 and container 26 are complementary and square in plan view. Whereas the compactor head and frame are square, the feed inlet 56 can be oriented in any direction at 90° intervals by rotation of the compactor head to face the feed inlet toward the desired side of frame 22. Setting the orientation of the feed inlet in this manner normally need only be done once, when initially installing the compactor. Frame 22 and compactor head 24 also can be complementary and rectangular in plan view (square being a more specific form of rectangular). In any case, feed inlet 56 can be oriented at least in either of two opposite directions by rotation of the compactor head relative to the frame. As a further alternative, the compactor head can externally define a rectangle in plan, with two longer sides and two shorter sides. However, the ram preferably extends downwardly only within the space of a square having a side equal in length to the shorter sides of the rectangle. This permits the compactor head to be mounted on a square frame dimensioned equal to the length of the shortest side, or on a frame corresponding to the larger rectangle. Of course a rectangular frame can receive a higher capacity container than a square one having the same side dimension.

The compactor and/or container also can be reconfigurable for changing the capacity of the container used, namely by providing a ready structure for extending the height of the container. Such a change may be desirable, for example, as a business grows, for reconfiguring a compactor dimensioned for a six cubic yard container to use an eight cubic yard container instead. The compactor of the invention is readily enlarged by simply inserting an extension frame between the original frame and the compactor head, for spacing the compactor head higher up on the frame while keeping the same dimensions in plan. A short section of frame can be provided as a retrofit kit, having holes corresponding to those of the compactor head and the original frame. This short section can correspond to the two lateral side walls of the smaller frame and be used in conjunction with stop 80, or can encompass the sides and the rear wall in the load/unload direction, thereby providing inherently providing a stop 80. The position of this stop 80 is chosen by appropriate mounting of the extension frame.

The smaller container can be replaced with a new and taller container for the larger capacity. Alternatively, the walls of the shorter container can be extended upwardly in a like manner using another retrofit kit to extend the container walls.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A compactor, comprising:

a frame having at least four legs, spaced and dimensioned to receive an upwardly opening container between the legs;

a compactor head mountable on top of the frame, the compactor head having a feed inlet for receiving material and powered means extendable downwardly into the container for compacting the material;

wherein the frame has two parallel guide members extending between adjacent legs for slidably supporting the container, the guide members opening on two opposite sides of the frame to permit receipt of the container from either of said two opposite sides for sliding along the guide members;

a remountable stop that is alternatively attachable to at least one of the frame and the compactor head at a first of said two opposite sides to block sliding of the container, such that the container is insertable on the other of said two opposite sides and slidably movable to abut inwardly against the stop;

wherein the stop is remountable on said other of the opposite sides to reconfigure the frame for receiving the container on the first of the opposite sides; and, wherein the guide members define a flared passage leading into the frame at both said opposite sides for guiding the container into the frame.

2. The compactor of claim 1, wherein the guide members comprise inwardly flanged angle irons and the angle irons are flared laterally outwardly at both said opposite ends.

3. The compactor of claim 1, wherein the guide members comprise inwardly flanged angle irons supporting the container from below.

4. The compactor of claim 1, wherein the guide members comprise lateral slide bars and the slide bars are tapered outwardly at both said opposite sides.

5. The compactor of claim 1, wherein the stop comprises a bar and wherein the attachment means comprise fasteners for attaching the bar to the compactor head adjacent to either of said opposite sides of the frame.

6. The compactor of claim 1, wherein the frame and the compactor head are complementary and square in plan, such that the feed inlet can be oriented in any direction at 90° intervals by rotation of the compactor head relative to the frame.

7. A compactor, comprising:

a frame having at least four legs, spaced and dimensioned to receive an upwardly opening container between the legs;

a compactor head mountable on top of the frame, the compactor head having a feed inlet for receiving material and powered means extendable downwardly into the container for compacting the material;

wherein the frame has two parallel guide members extending between adjacent legs for slidably supporting the container, the guide members opening on two opposite sides of the frame to permit receipt of the container from either of said two opposite sides for sliding along the guide members;

a remountable stop that is alternatively attachable to at least one of the frame and the compactor head at a first of said two opposite sides to block sliding of the container, such that the container is insertable on the other of said two opposite sides and slidably movable to abut inwardly against the stop;

wherein the stop is remountable on said other of the opposite sides to reconfigure the frame for receiving the container on the first of the opposite sides, further comprising attachment means on both said opposite sides of the frame for attachment of the stop; and, wherein the stop comprises a bar, the guide members comprise lateral slide bars, and wherein the attachment means comprise fittings on the slide bars for attaching the bar endwise to the fittings.

8. The compactor of claim 7, wherein the attachment means further comprise fasteners for attaching the bar to the compactor head adjacent to either of said opposite sides of the frame.

9. The compactor of claim 7, wherein each of the fittings comprises a shackle and at least one pin receivable in an opening adjacent to an end of the bar.

10. The compactor of claim 7, wherein the frame and the compactor head are complementary and rectangular in plan, such that the feed inlet can be oriented in either of two opposite directions by rotation of the compactor head relative to the frame.

11. The compactor of claim 10, wherein the structures engageable for moving the container comprise channels disposed on lateral sides of the dumpster.

12. The compactor of claim 11, further comprising at least one backout preventer abutment comprising a wedge attached to at least one of the channels at an inlet thereof on a side of the frame opposite from said stop, the abutment facing toward said stop.

13. The compactor of claim 7, wherein the container is a dumpster having structures engageable for moving the container relative to the frame.

14. A compactor, comprising:

a frame having at least four legs, spaced and dimensioned to receive an upwardly opening container between the legs;

a compactor head mountable on top of the frame, the compactor head having a feed inlet for receiving material and powered means extendable downwardly into the container for compacting the material;

wherein the frame has two parallel guide members extending between adjacent legs for slidably supporting the container, the guide members opening on two opposite sides of the frame to permit receipt of the container from either of said two opposite sides for sliding along the guide members;

a remountable stop that is alternatively attachable to at least one of the frame and the compactor head at a first of said two opposite sides to block sliding of the container, such that the container is insertable on the other of said two opposite sides and slidably movable to abut inwardly against the stop;

wherein the stop is remountable on said other of the opposite sides to reconfigure the frame for receiving the container on the first of the opposite sides; and, wherein the compactor head externally defines a rectangle in plan, the powered means extends downwardly only within a square having a side equal in length to a shortest side of the rectangle, and the compactor head is alternatively mountable on a square frame and on a rectangular frame.

* * * * *